US010463896B2

(12) United States Patent
Sadinski

(10) Patent No.: US 10,463,896 B2
(45) Date of Patent: Nov. 5, 2019

(54) FLAME ARRESTOR AND SAFETY CABINET EQUIPPED THEREWITH

(71) Applicant: Jamco Products, Inc., Akron, OH (US)

(72) Inventor: Robert L Sadinski, Tallmadge, OH (US)

(73) Assignee: JAMCO PRODUCTS, INC., Akron, OH (US)

( * ) Notice: Subject to any disclaimer, the term of this patent is extended or adjusted under 35 U.S.C. 154(b) by 21 days.

(21) Appl. No.: 15/916,298

(22) Filed: Mar. 9, 2018

(65) Prior Publication Data

US 2019/0275360 A1 Sep. 12, 2019

(51) Int. Cl.
*A62C 2/06* (2006.01)
*A62C 3/06* (2006.01)
*B65D 51/16* (2006.01)

(52) U.S. Cl.
CPC ..... *A62C 3/14* (2013.01); *A62C 3/065* (2013.01); *B65D 51/1611* (2013.01); *B65D 51/1616* (2013.01)

(58) Field of Classification Search
CPC ..... A62C 3/14; A62C 3/065; B65D 51/1611; B65D 51/1616
USPC ..... 312/409
See application file for complete search history.

(56) References Cited

U.S. PATENT DOCUMENTS 3,348,023 A * 10/1967 Lewis ..... F24C 14/02 126/198
3,356,256 A * 12/1967 Szego ..... A62C 3/06 220/88.1
3,403,954 A * 10/1968 Williams ..... A62C 2/12 16/48.5
3,623,785 A * 11/1971 Williams ..... A47B 81/007 312/267
4,191,412 A * 3/1980 LeKander ..... A62C 2/16 292/182
4,262,448 A * 4/1981 Flider ..... B01L 1/50 312/324
4,361,190 A * 11/1982 Szego ..... A62C 3/02 169/48
5,727,451 A * 3/1998 DeMars ..... A47J 37/044 99/386
5,813,739 A * 9/1998 White ..... A47B 81/00 220/201
5,816,332 A * 10/1998 Alhamad ..... A62C 3/0257 169/45
6,698,522 B1 * 3/2004 Alhamad ..... A62C 3/06 122/17.1
6,729,701 B2 * 5/2004 Carter ..... A62C 2/242 292/166
8,023,818 B2 * 9/2011 Schmidt ..... G02B 7/24 312/409
8,528,766 B2 * 9/2013 Huang ..... B60S 5/02 220/88.1
2008/0305299 A1 * 12/2008 Diaz Del Rio Perez ..... A62C 3/065 428/134
2009/0045203 A1 * 2/2009 Ehrlich ..... E05G 1/02 220/592.01

(Continued)

*Primary Examiner* — Hanh V Tran

(57) ABSTRACT

A safety cabinet for storing flammable liquids is provided with a flame arresting vent. The flame arresting vent or "flame arrestor" allows flammable vapors inside the cabinet to leave the cabinet's interior but prevents flame from flowing into the cabinet's interior from outside the cabinet.

15 Claims, 14 Drawing Sheets

(56) References Cited

U.S. PATENT DOCUMENTS

| | | | | |
|---|---|---|---|---|
| 2009/0260303 | A1* | 10/2009 | Jensen | A62C 2/065<br>52/95 |
| 2013/0193818 | A1* | 8/2013 | Sturm | A62C 2/242<br>312/222 |
| 2013/0200767 | A1* | 8/2013 | Mueller | A47B 81/00<br>312/295 |
| 2014/0166623 | A1* | 6/2014 | Page, II | H01H 33/53<br>218/157 |
| 2014/0182864 | A1* | 7/2014 | de St. Jeor | A62C 3/14<br>169/45 |
| 2015/0001217 | A1* | 1/2015 | Cray | A62C 3/065<br>220/88.2 |
| 2015/0300996 | A1* | 10/2015 | Andreucci | G01N 33/225<br>73/23.42 |
| 2017/0335587 | A1* | 11/2017 | Prendergast | E04H 5/02 |
| 2018/0056100 | A1* | 3/2018 | Cockerham | A62C 4/02 |
| 2018/0296866 | A1* | 10/2018 | Riordan | A62C 3/065 |
| 2019/0022568 | A1* | 1/2019 | Chernansky | H02B 1/565 |
| 2019/0056104 | A1* | 2/2019 | Ward | F23D 14/82 |

* cited by examiner

FLAME ARRESTOR AND SAFETY CABINET EQUIPPED THEREWITH

BACKGROUND

As used herein, the term "safety cabinet" refers to a cabinet used to store flammable liquids. They can rest on a floor, a bench top or be wall mounted.

Because they are used to store flammable liquids, safety cabinets are preferably provided with at least one flame arresting vent through which flammable vapors from stored flammable liquids can be released from the cabinet. A known problem with prior art safety cabinet flame arresting vents is their inability to stop a flame that is outside the cabinet from entering the cabinet's interior through the vent and igniting a flammable mixture in the cabinet. A flame arresting vent (flame arrestor) for a safety cabinet which prevents a flame from propagating into a safety cabinet from outside the cabinet would be an improvement over the prior art.

DETAILED DESCRIPTION

Figure 1:
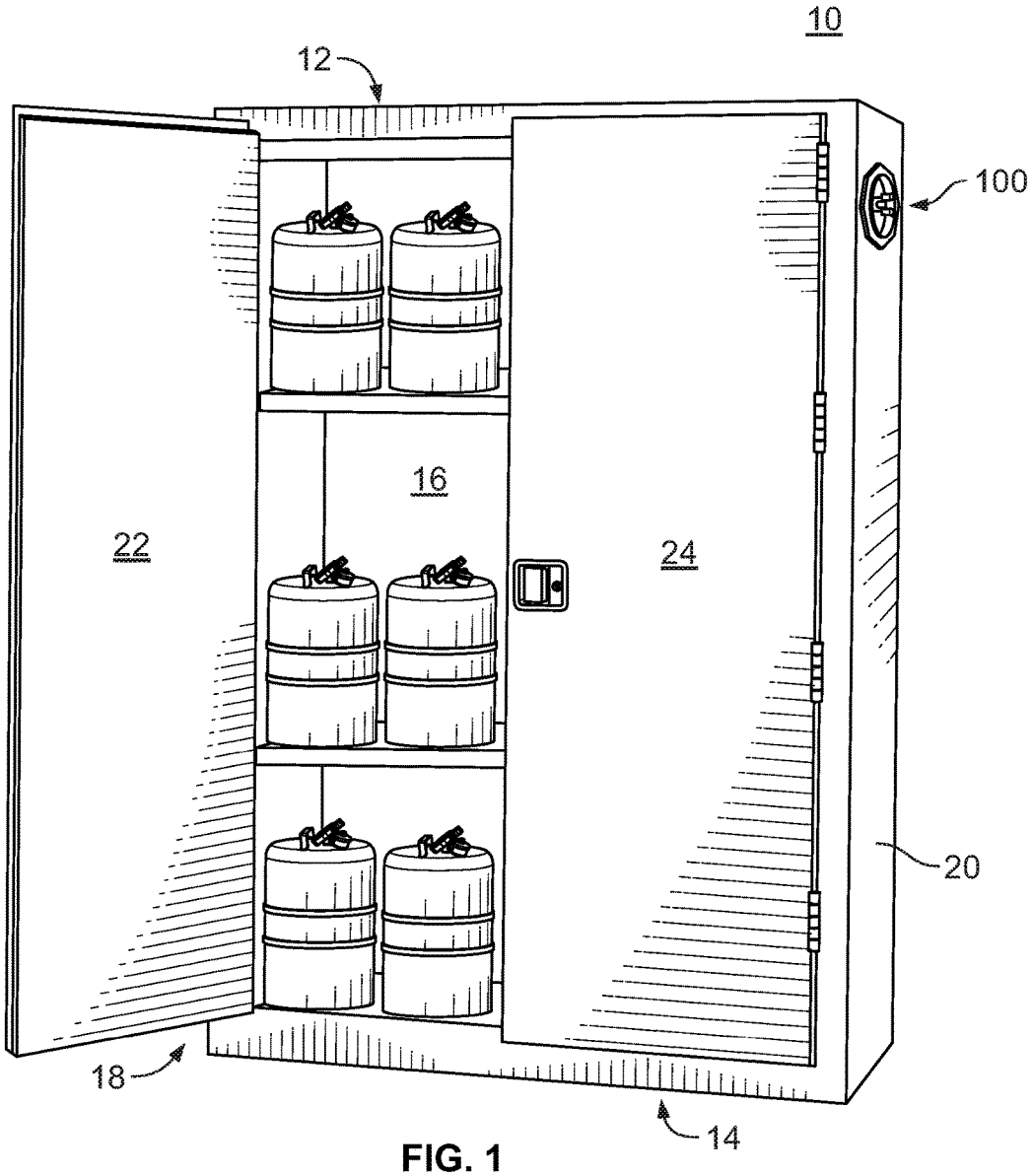
FIG. 1 depicts a safety cabinet with a vent having a flame arrestor.

FIG. 1 depicts a safety cabinet 10 having vents with a flame arrestor although only one flame arrestor 100 is visc. The cabinet 10 comprises a top panel 12, a bottom panel 14, a rear panel 16, a left panel 18, a right side panel 20, a left door 22 and a right door 24.

The cabinet 10 preferably has two flame arrestors but in the embodiment shown, only the flame arrestor 100 through the right side panel 20 is visible; the other flame arrestor is in the left panel 18. It allows flammable mixtures inside the cabinet 10 to be exchanged with air outside the cabinet 10. The size of vent area provided by the flame arrestor 100 is as a design choice and will be dependent on factors that include the size of the cabinet, e.g., floor mounted vs. wall mounted, the types of liquids stored and ambient temperatures. As described below, the flame arrestor 100 is configured to prevent a flame on the outside of the cabinet 10 from traveling into the cabinet through the flame arrestor 100. Stated another way, the flame arrestor is able to vent volatile fuel mixtures from the inside of the cabinet to the outside but prohibits the migration of a flame from the outside of the cabinet back into the cabinet through the flame arrestor.

Figure 2:
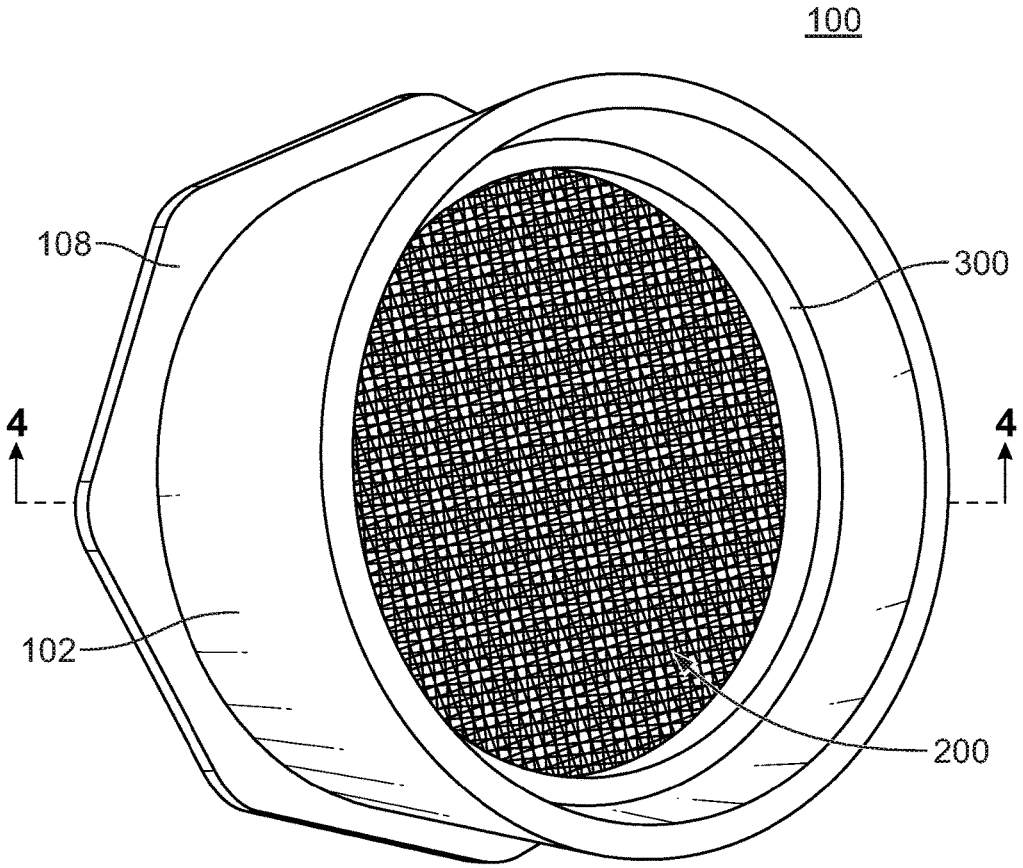
FIG. 2 is a perspective view of a flame arrestor for a safety cabinet.

FIG. 2 is a perspective view of the flame arrestor 100. It comprises a hollow metal tube 102 inside of which is an assembly of wire mesh layers 200. A gas sealing ring 300, which is inside the hollow tube 102, holds the assembly of wire mesh layers 200 in the hollow tube 102 but more importantly, it seals a space between the inside diameter of the hollow tube 102 and the outside diameter of the round wire mesh layers that comprise the assembly of wire mesh layers 200. The ring 300, which is preferably metal but alternatively plastic, is thus considered to be a "sealing ring" because it closes space between the outside diameter of the wire mesh assembly layers 200 and the inside diameter of the hollow tube 102. A mounting flange 108 attaches the flame arrestor 100 to the side of a cabinet using an adhesive, mechanical fasteners or welding. A gas sealing ring 300 holds the wire mesh layers 200 in the tube 102.

Figure 3:
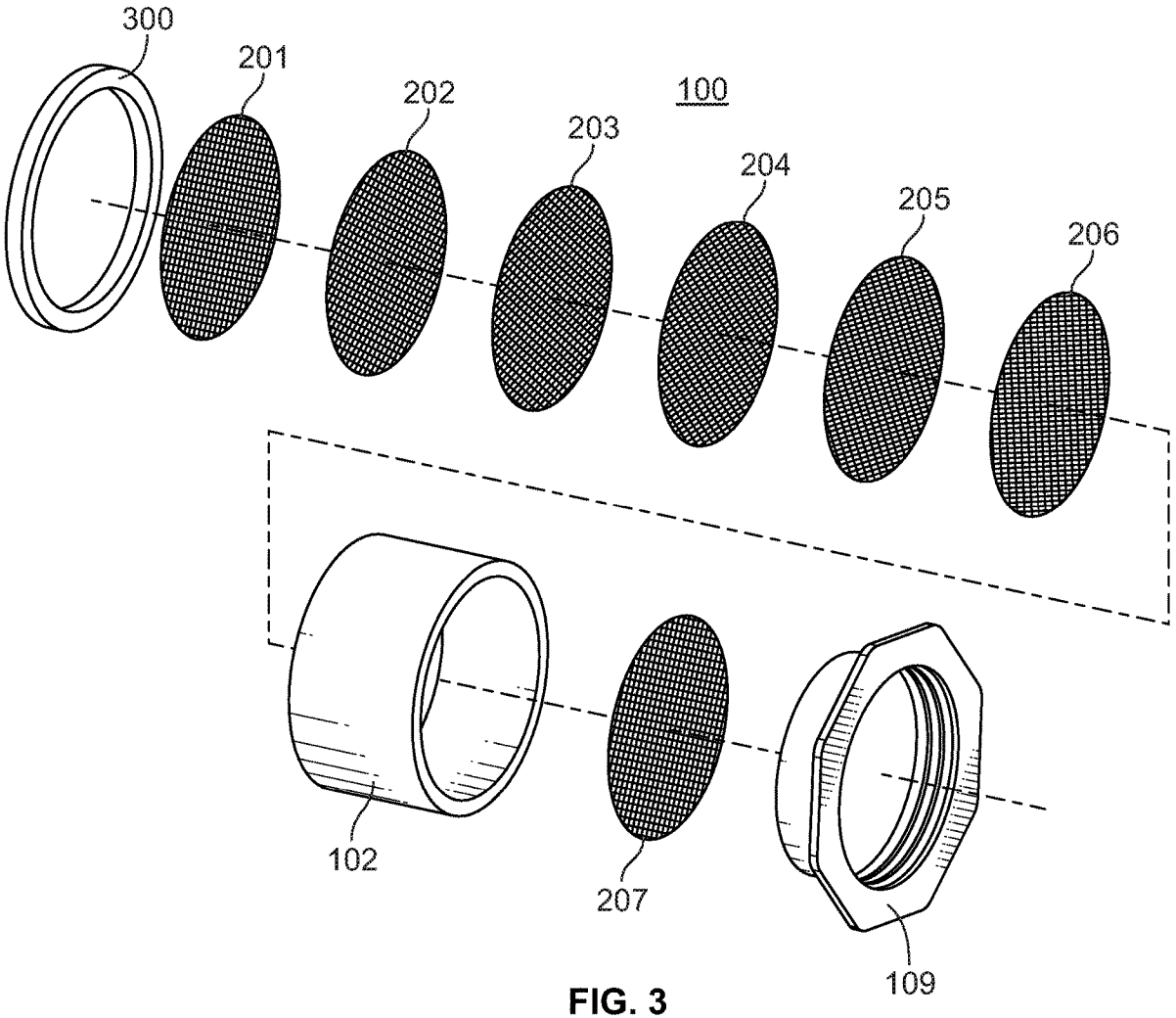
FIG. 3 is an exploded view of the flame arrestor shown in FIG. 2.

FIG. 3 is an exploded view of the flame arrestor 100. In the embodiment shown in FIG. 3, seven layers of wire mesh 201-207 inside the hollow tube 102 are held in place against a lip 109 by the gas sealing ring 300. Each "layer" of wire mesh 201-207 is a round or disc-shaped wire screen. The layers are considered to be parallel or at least substantially parallel to each other. The volume of gas flowing through each screen 201-207 is substantially uniform. As described below, the flame arrestor 100 stops the migration of a flame through a combustible fuel mixture inside the tube 102 and inside the layers 201-207 by absorbing, i.e., sinking, heat energy from a flame front traveling toward the inside of the cabinet 10. Those of ordinary skill in the art should therefore recognize that increasing the number of wire mesh layers in the flame arrestor 100 increases the efficacy of the flame arrestor but at the expense of a decreased air exchange rate through it.

The embodiment of the flame arrestor 100 shown in FIG. 3 has seven wire mesh layers. Experimentation, however, revealed that effective flame arresting can be accomplished with as few as three layers. A two-layer flame arrestor was determined to be unable to stop flame propagation through the tube 102. It therefore appears that three wire mesh layers is the minimum number of layers required to provide an effective flame arrestor for a safety cabinet.

Figure 4:
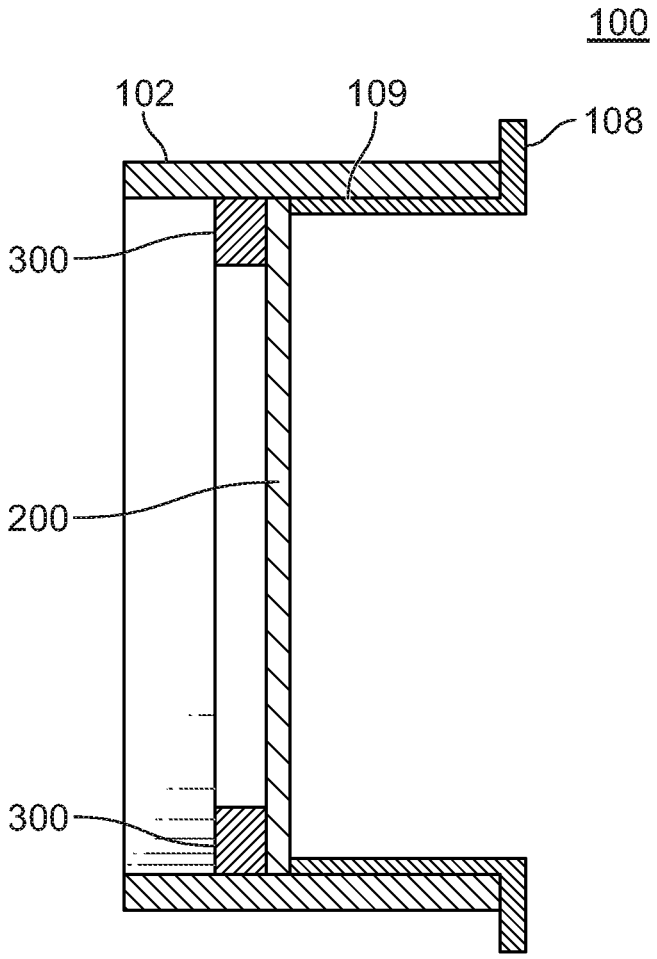
FIG. 4 is a cross-sectional view of the flame arrestor shown in FIG. 2.

For the sake of completeness, FIG. 4 is a cross-sectional view of the flame arrestor 100. The mounting flange 108 extends inwardly a small distance. The assembly of wire mesh layers 200 is held against a lip provided by the mounting flange 108. The gas sealing ring 102 holds the assembly of wire mesh layers 200 in place.

Figure 5:
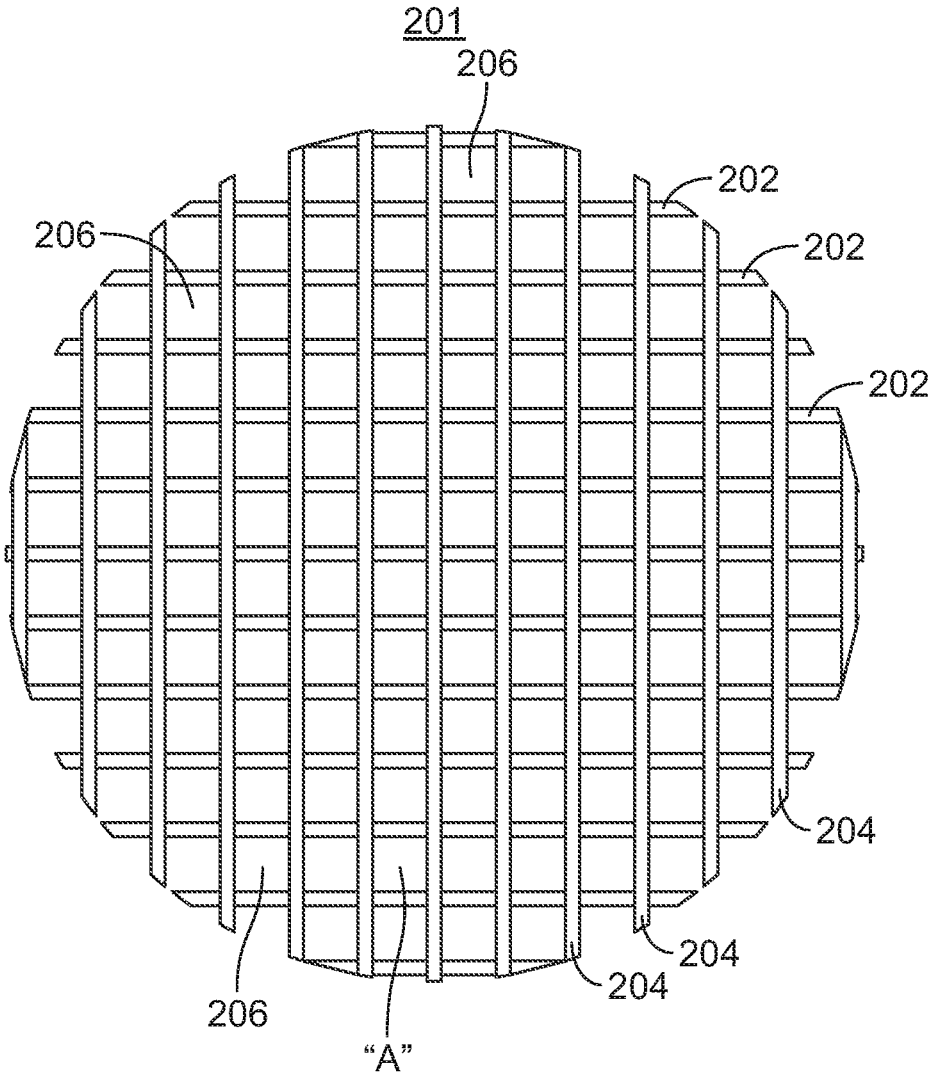
FIG. 5 is a front view of a wire mesh layer.

FIG. 5 is a front view of one wire mesh layer 201 shown in FIG. 3. The wire mesh layer 201 comprises two sets of corrosion-resistant metal wires. A first set of wires is comprised of corrosion-resistant wires 202, which are substantially parallel to each other and substantially uniformly-spaced apart from each other. The wires forming the "first set of wires" are depicted as being substantially horizontal.

A second set of wires is also comprised of corrosion-resistant wires 204. They too are substantially parallel to each other and substantially uniformly-spaced apart from each other. In FIG. 5, the wires of the "second set of wires" are depicted as being substantially vertical. The first and second sets of wires thus lie across each other and are thus considered herein to be "crossed."

For the sake of convenience and brevity, the substantially horizontal wires and the "first set of wires," are identified herein by the same reference numeral 202 inasmuch as they are the same. Similarly, the substantially vertical wires and the "second set of wires" are identified herein by the same reference numeral 204 since they too are the same.

Those of ordinary skill in the art should know that a parallelogram is a quadrilateral having opposite sides that are parallel and equal length. A square, a rectangle, and a rhombus are all parallelograms.

The crossed first and second sets of wires 202, 204 are coupled to each other, preferably by interweaving but alternatively by welding. The crossed and coupled sets of wires thus define sets of wire parallelograms 206. In FIG. 5, the parallelograms 206 as shown are essentially square. Parallelograms of other shapes could certainly be used. Neither this description nor the claims should be construed as requiring screens, the crossed wires of which form square-shaped parallelograms.

The spacing between the wires of the first set 202 and the spacing between the wires of the second set 204 define an open area of each parallelogram 206. The open area, A, of each parallelogram 206, each of which is substantially square, is considered to be a "size" of the wire mesh formed by the crossed sets of wires.

Figure 6:
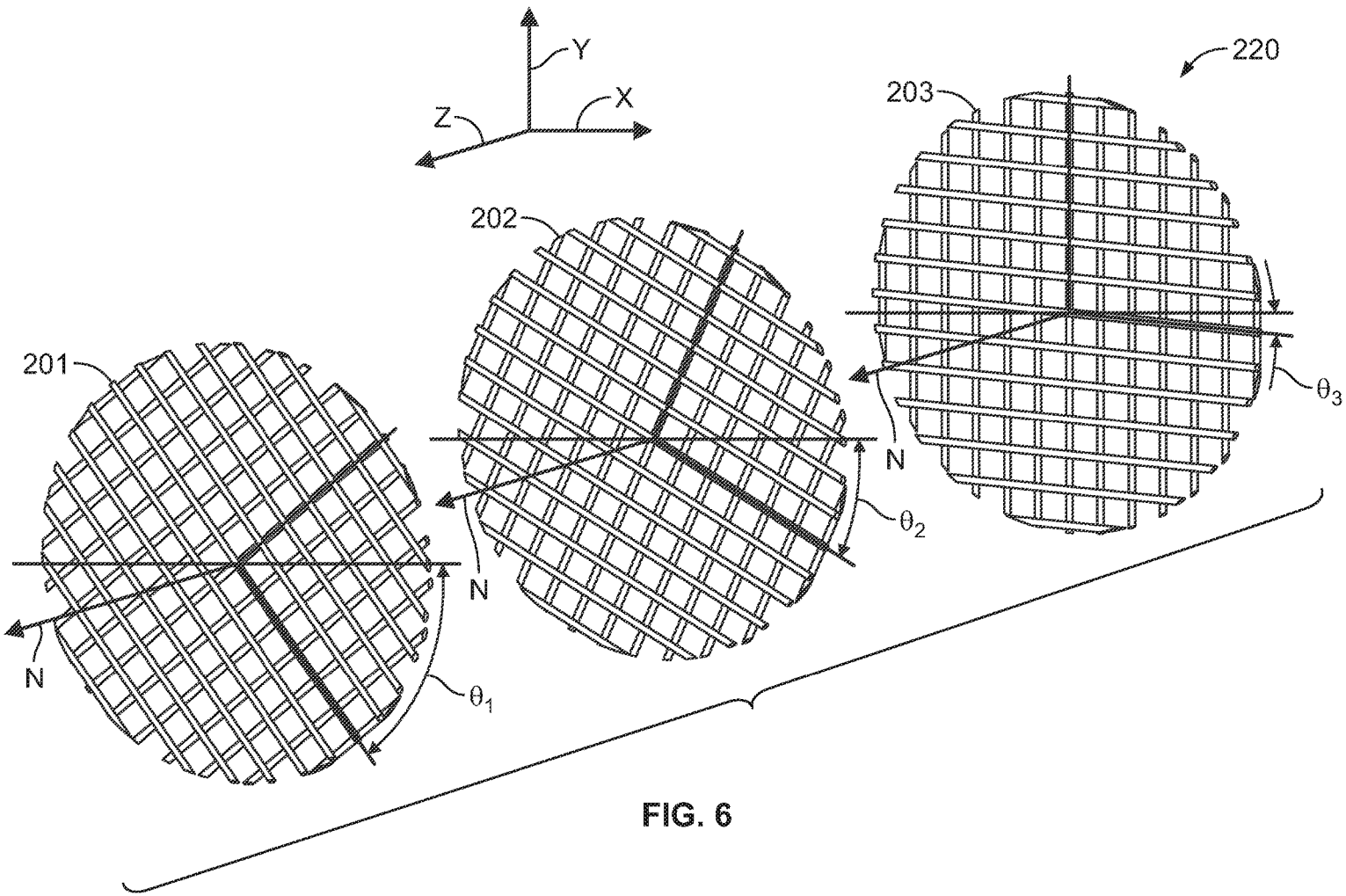
FIG. 6 is an exploded view of a first embodiment of an assembly of wire mesh layers.

FIG. 6 is an exploded view of three wire mesh layers 201, 202 and 203, i.e., three, individual sections or pieces of wire screen, which comprise an assembly 220 of wire mesh layers. The layers 201, 202 and 203 are either parallel or at least substantially parallel to each other.

For purposes of explanation and illustration, each wire mesh layer 201, 202 and 203 is considered to have a normal, N, which is considered to be orthogonal to each layer and which extends away from each layer. Each layer 201 is rotated around its normal, N, by a different angle, theta. The first layer 201 is rotated clockwise about its normal, N1, by an angle θ1. The second layer 202 is rotated clockwise about its normal, N2, by a different angle, θ2. The third layer 203 is rotated about its normal, N3, by a third angle θ3.

Figure 7:
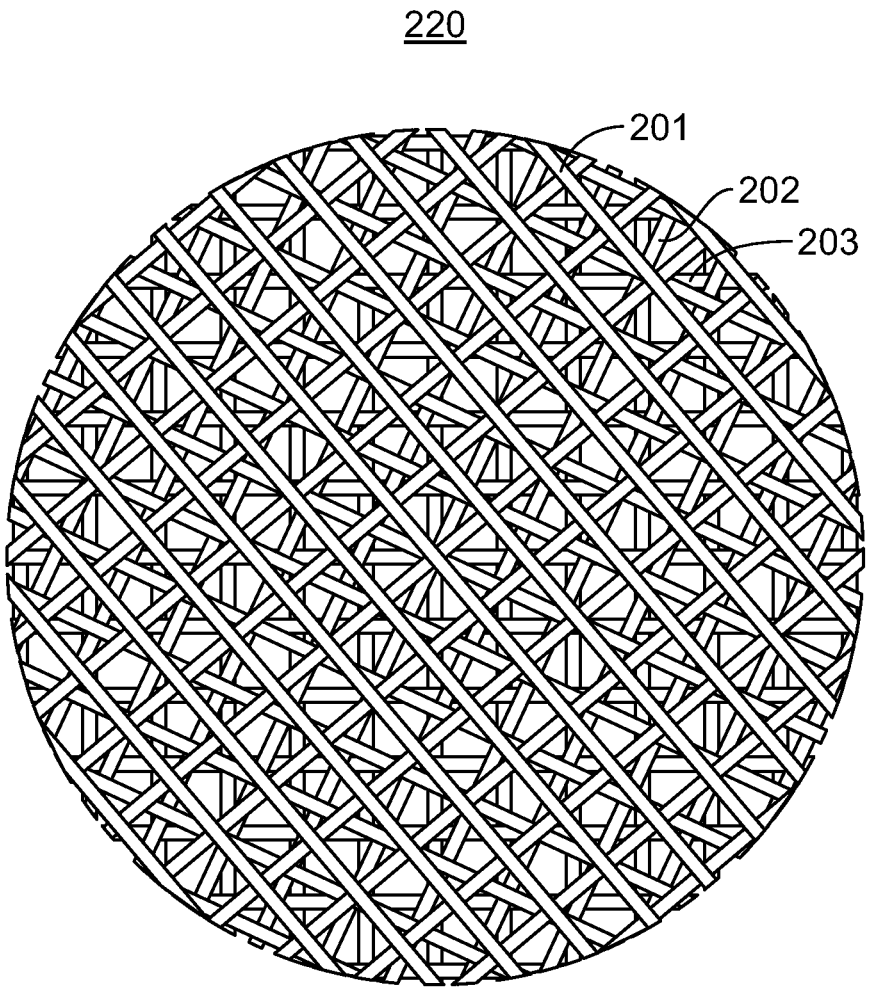
FIG. 7 is a front view of the assembly of wire mesh layers.

When the wire mesh layers 201, 202, and 203 are placed into the tube 102, they abut, i.e., are in physical contact with each other and form a mesh heat sink for a flame, best seen in FIG. 7, which is a front view of the assembly of wire mesh layers 201, 202, and 203. FIG. 7 also shows how the parallelogram-shaped openings through each wire mesh layer is occluded or blocked by the wires of layers "behind" it and that adding more layers further occludes the openings in front of them.

Figure 8:
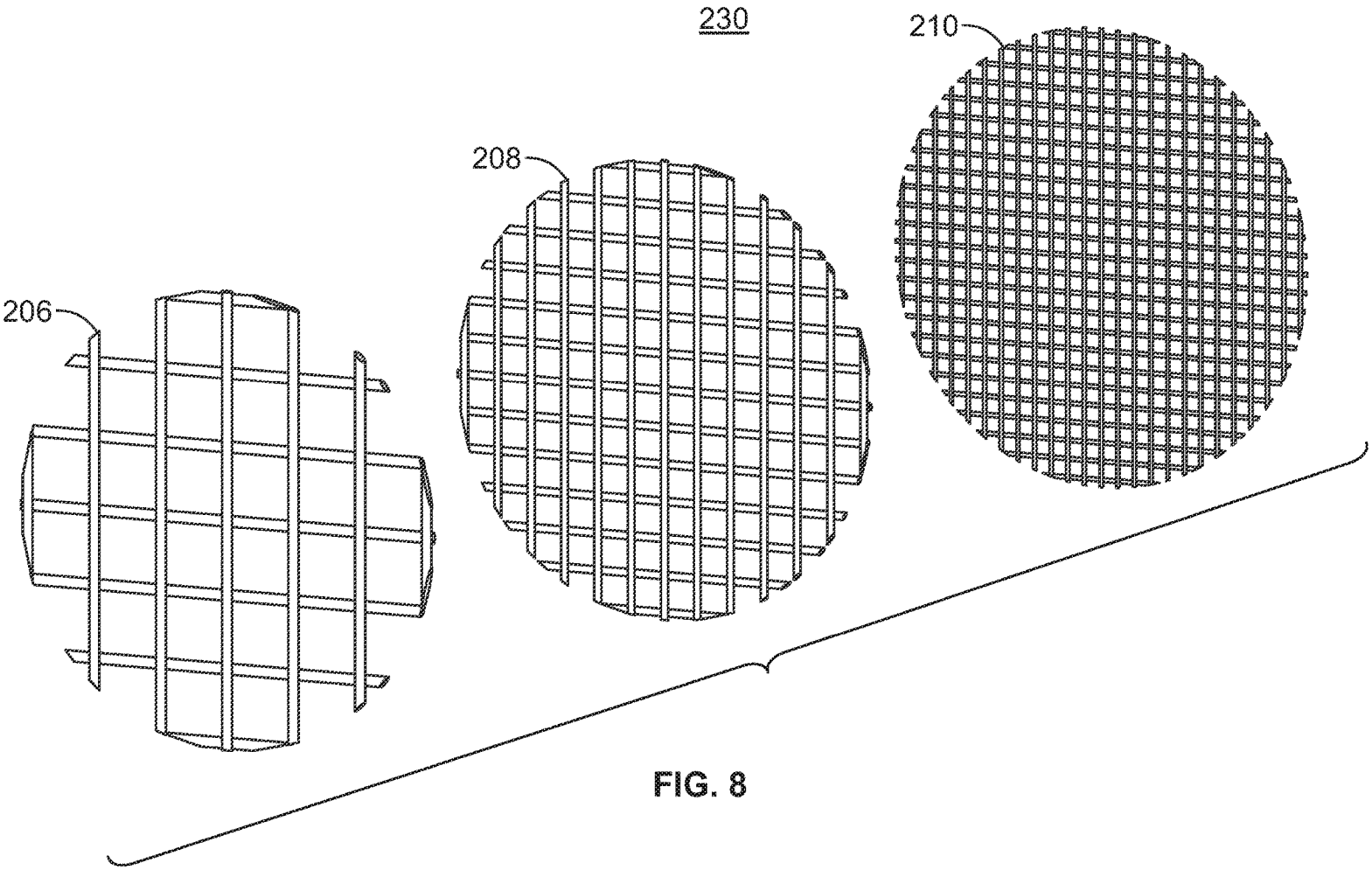
FIG. 8 is a perspective view of a second embodiment of an assembly of wire mesh layers.
Figure 9:
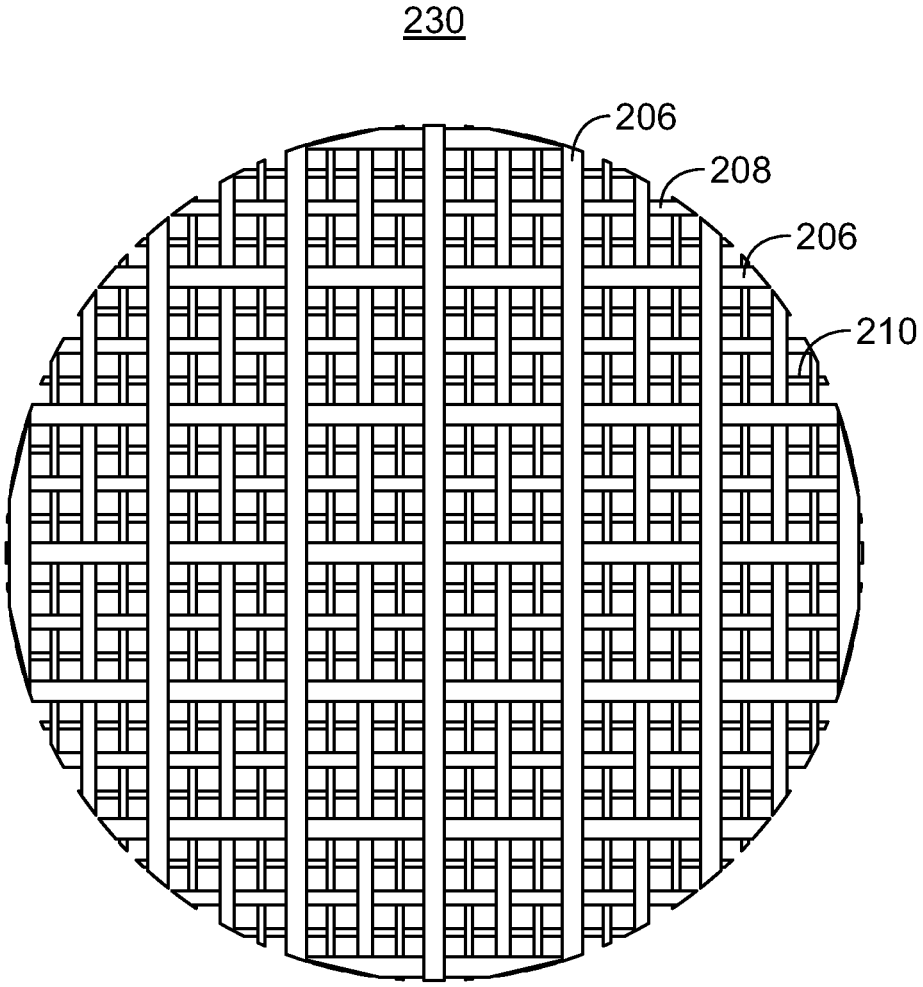
FIG. 9 is a front view of the three wire mesh layers shown in FIG. 8.

FIG. 8 is a perspective view of a second embodiment of an assembly 230 of three wire mesh layers 206, 208 and 210, the mesh sizes of which are different from each other. The layers 206, 208 and 210 are at least substantially parallel. A first wire mesh layer 206 has a mesh size greater than the mesh size of a second wire mesh layer 208, which is located between the first 206 and third 210 layers. The second wire mesh layer 206 has a mesh size greater than a third wire mesh layer 210. FIG. 9 is a front view of the three wire mesh layers 206, 208 and 210. Unlike the rotated layers shown in FIG. 7, the wires of each layer 206, 208 and 210 in FIG. 8 are at the same angle relative to horizontal.

Figure 10:
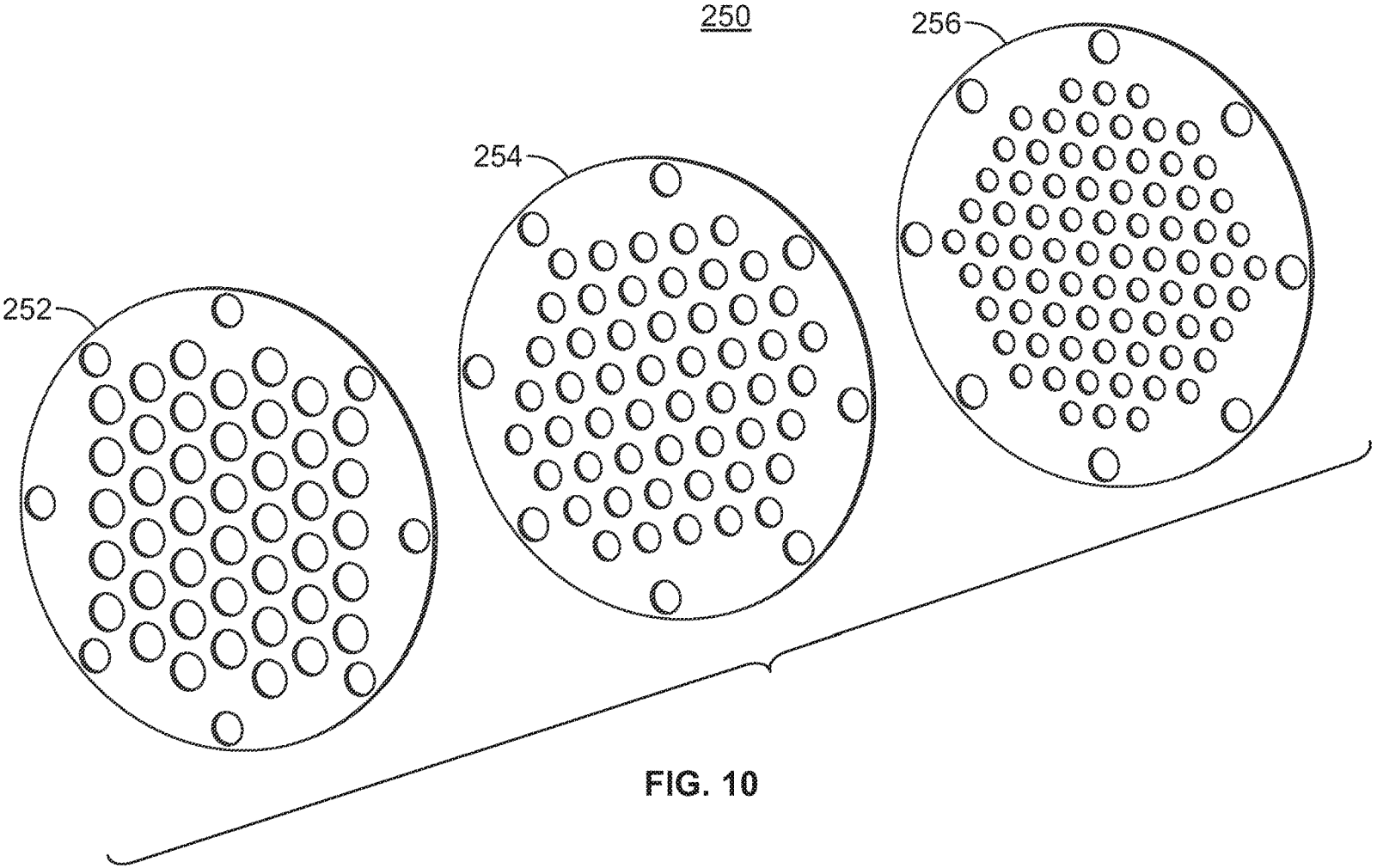
FIG. 10 is an exploded view of a third embodiment of an assembly of wire mesh layers
Figure 11:
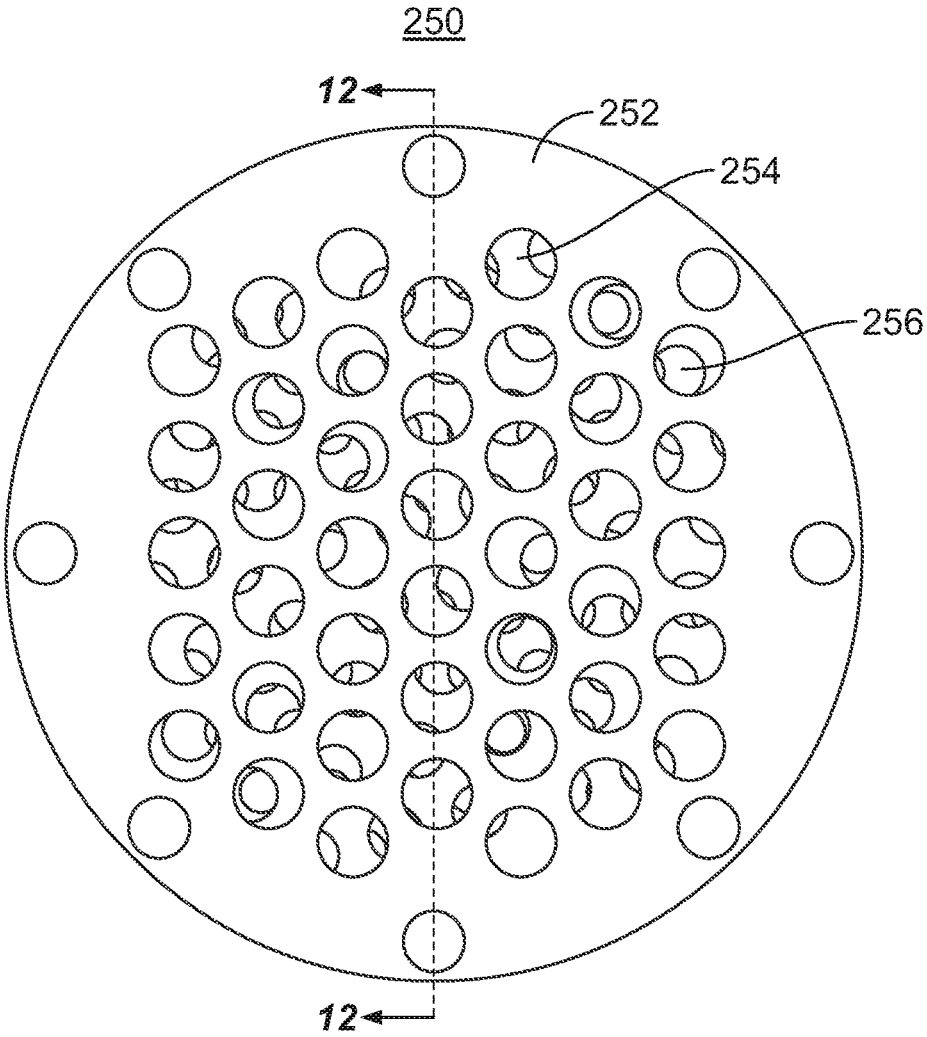
FIG. 11 is a front view of the third embodiment of a wire mesh layer assembly made up of thin sheets of perforated metal.
Figure 12:
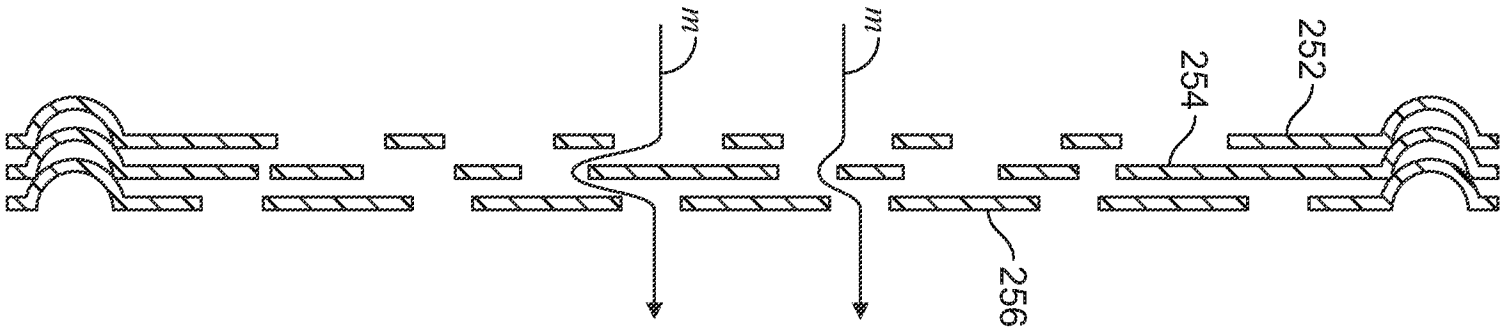
FIG. 12 is a cross-sectional view of the third embodiment of a wire mesh assembly shown in FIG. 12.

FIG. 10 is an exploded view of a third embodiment of an assembly 250 of wire mesh layers 252, 254 and 256. Unlike the first two embodiments of wire mesh assemblies 220 and 230, the third embodiment 250 is made up of three layers of perforated sheet metal. As with the other embodiments, the layers of sheet metal are considered herein to be either parallel or substantially parallel. The holes in each metal layer 252, 254 and 256 get progressively smaller and greater in number. FIG. 11 is a front view of the third embodiment of a wire mesh layer assembly 250. FIG. 12 is a sectional view taken through section lines A-A. (As used herein and for claim construction purposes, the term, "wire mesh layer" should be construed to include a layers of perforated metal.)

As best shown in FIG. 12, molecules, M, of flammable gas or flammable vapor are depicted as being unable to pass directly, i.e., along a straight line, through the holes of the stacked layers 252, 254, 256. As least some molecules M, strike at least one layer of metal and travel at least a short distance across the face or surface of at least one layer. Gas molecules at an elevated temperature that strike a metal surface at a lower temperature lose heat energy to the metal. If a sufficient surface area and mass of relatively cool metal is adequately exposed to gas molecules undergoing combustion, the gas molecules will be cooled to a temperature below which they will not burn.

Figure 13:
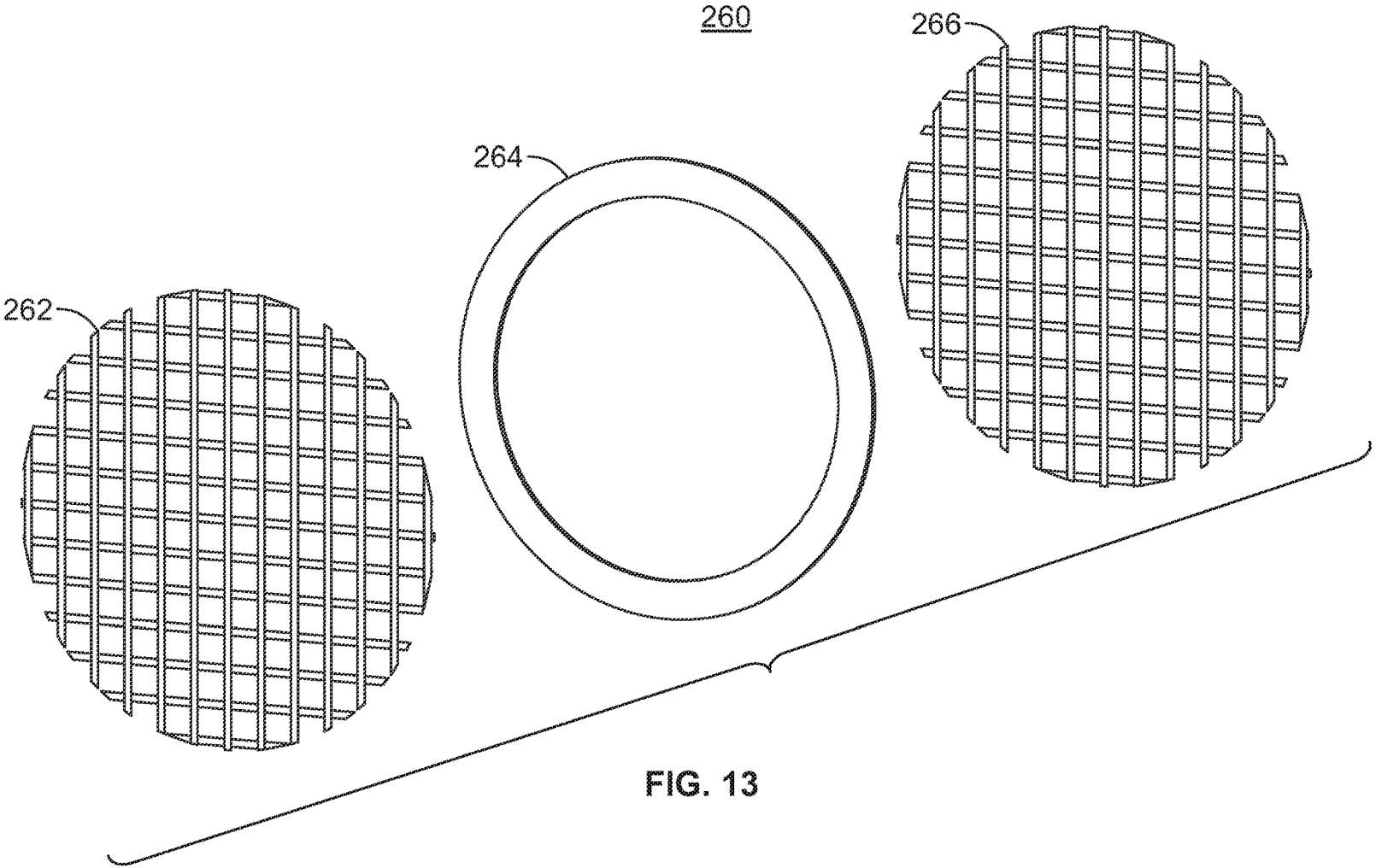
FIG. 13 a fourth embodiment of a wire mesh assembly comprising two wire mesh layers between which is an annulus or ring.

Referring now to FIG. 13, a fourth embodiment of a wire mesh assembly 260 comprises two wire mesh layers 262 and 266 between which is a metal annulus or ring 264 The ring 264 is considered to be located between and thus "sandwiched" between the wire mesh layers 262 and 267. The ring 264 provides a narrow "plenum" between the wire mesh layers 262 and 264. The ring absorbs heat energy from gas molecules in the plenum. It also absorbs heat energy from the wire mesh. The ring thus provides an additional heat sink, the effective thermal mass of which can be selected as a design choice.

In each wire mesh assembly embodiment, the wire mesh layers are arranged such that there is essentially no direct pathway through them through which at least some gas molecules can pass without passing over at least one wire thereby losing heat energy to the wire by conduction. Stated another way, at least some of the gas molecules flowing through the flame arrestor 100 will pass over at least one but preferably at least three heat-absorbing wires and cooling those molecules below a temperature at which combustion cannot be maintained.

Figure 14:
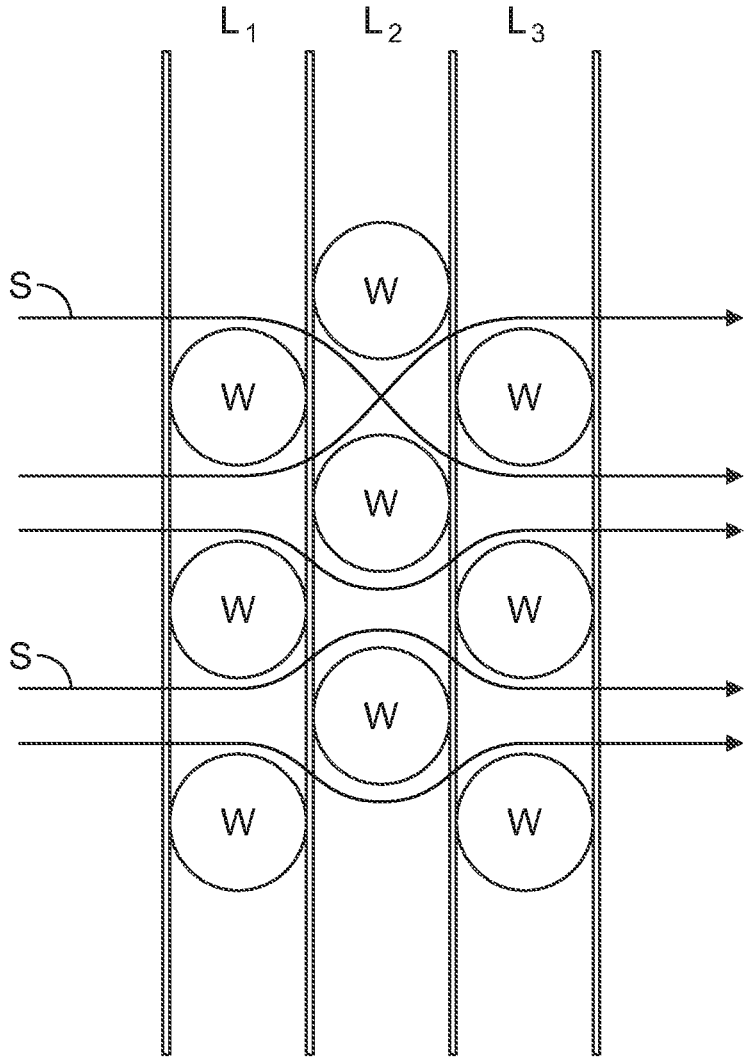
FIG. 14 is a diagrammatic depiction of the flow of gas molecules through three wire mesh layers.

FIG. 14 is a diagrammatic depiction of the flow of gas molecules through three wire mesh layers. Streamlines, S, represent how gas molecules of a flame front are required to travel over and around individual wires, W, of three abutting wire mesh layers, L1, L2, and L3 that form an assembly of wire mesh layers. The streamlines, S, have a boustrophondic or serpentine shape as they pass through the substantially-parallel layers of wire mesh, losing heat energy to the wires of each layer. Adding one or more additional layers increases the number of surfaces over which the gas molecules flow increases the heat loss from a flame front accordingly.

Those of ordinary skill in the art should recognize that the embodiments of a flame arrestor 100 provide an improved level of safety over prior art flame arrestors by passively extinguishing flame inside the arrestor 100. Passive flame suppression is accomplished by an assembly of separate wire mesh layers, which are substantially parallel to each other, each of which either abuts at least one adjacent layer or is held closely proximate thereto by a thin ring between layers, which will absorb heat from the wire mesh layers. The wires that make up each wire mesh layer are also considered herein to be functionally equivalent to fluid-carrying core tubes in automobile engine radiator or heater core, at least during the short time period during which the wires are exposed to combusting gas molecules.

Those of ordinary skill should recognize that corrosion on the wires' surface will impede heat conduction. The wires (and sheet metal) should be made of a material that will not corrode, i.e., a metal that is corrosion resistant, examples of which include aluminum, stainless steel or copper.

In the embodiments shown in FIGS. 3-7, the wires were a "304" stainless steel wire having a nominal diameter of about 0.016 inches. The open areas of the parallelograms were about 0.034 square inches. The open area of the sets of wires was about 46%.

Finally, the wire mesh layers are depicted in the figures using straight lines. The use of straight lines to depict wires and wire mesh layers should not be construed as requiring the wires of the mesh layers to be straight. Indeed, the wires from which the wire mesh layers are made can be straight or corrugated or combinations of both. The wires can also be interwoven.

The foregoing description is for purposes of illustration only. The true scope of the invention is set forth in the following claims.

What is claimed is:

1. A flame arrestor for a safety cabinet, the flame arrestor comprising:

a hollow tube having first and second opposing ends;

a stack of metal wire mesh layers in the hollow tube, the stack of wire mesh layers comprising:

a first end and an opposing second end;

a first wire mesh layer proximate the first end of the stack of metal wire mesh layers;

a second wire mesh layer proximate the opposing second end of the stack of wire mesh layers; and an intermediate metal wire mesh layer between the first and second wire mesh layers;

wherein the metal wire mesh layers are substantially planar and substantially parallel to each other;

wherein at least two of the metal wire mesh layers abut each other in the hollow tube;

wherein the metal wire mesh layers are configured to allow gas molecules to pass through the stack of metal wire mesh layers and pass through the hollow tube when the wire mesh layers are heated but do not form a seal in the hollow tube that will block the hollow tube when the stack of metal wire mesh layers absorb heat.

2. The flame arrestor for a safety cabinet of claim 1, wherein each wire mesh layer comprises:

a first set of substantially evenly-spaced-apart corrosion-resistant metal wires abutting a second set of substantially evenly-spaced-apart corrosion-resistant metal wires, wires of the first set of wires being substantially parallel to each other, wires of the second set of substantially evenly-spaced wires being substantially parallel to each other, wires of the first set of substantially-evenly spaced wires crossing wires of the second set of wires at a first predetermined angle, the crossed first and second sets of wires defining wire parallelograms each wire parallelogram having substantially congruent opposite sides defining a substantially parallelogram-shaped opening having an open area, which is sufficient to allow gaseous molecules to pass there through.

3. The flame arrestor for a safety cabinet of claim 1, wherein a metal, annulus-shaped heat-absorbing metal ring is sandwiched between and contacting both the first wire mesh layer and the intermediate wire mesh layer, wherein the metal, annulus-shaped heat-absorbing metal ring is sized, shaped and arranged to absorb heat energy from the abutted wire mesh layers and to define a plenum between the first wire mesh layer and the intermediate wire mesh layer.

4. The flame arrestor for a safety cabinet of claim 2, wherein a predetermined side of the wire parallelograms comprising the first wire mesh layer is oriented at a first predetermined angle relative to horizontal;

wherein the same predetermined side of the wire parallelograms comprising the second wire mesh layer is oriented at a second predetermined angle relative to horizontal such that wires of the second wire mesh layer at least partially occlude the parallelogram-shaped openings of the first wire mesh layer;

wherein the same predetermined side of wire parallelograms comprising the intermediate wire mesh layer is oriented at a third predetermined angle relative to horizontal such that wires of the intermediate wire mesh layer at least partially occlude the parallelogram-shaped openings of the first and second wire mesh layers; and wherein the first, second and third predetermined angles are selected such that, at least some molecules of a gas passing through the plurality of wire mesh layers, will follow a path through the plurality of wire mesh layers, which is at least partially boustrophedonic.

5. The flame arrestor of claim 4, wherein the first, second and third angles are different from each other.

6. The flame arrestor of claim 4, wherein the first, second and third angles are substantially the same.

7. The flame arrestor of claim 5, wherein the first, second and intermediate wire mesh layers and the first, second and third angles are selected and arranged such that there is substantially no pathway through the first, second and intermediate wire mesh layers through which a plurality of gas molecules can pass without striking at least one wire in each wire mesh layer.

8. The flame arrestor for a safety cabinet of claim 2, further comprising:

a sealing ring, sized shaped and arranged to close a space located between the periphery of the first, second and intermediate wire mesh layers and an inside surface of the hollow tube.

9. The flame arrestor for a safety cabinet of claim 5, wherein the wire mesh layers are made of 304 stainless steel wires having a nominal diameter of about 0.016 inches, and wherein the holes formed by the anti-parallel first and second sets of wires have an open area of about 0.034 square inches and wherein the open area of the wire mesh is about 46%.

10. A flame arrestor for a safety cabinet, the flame arrestor comprising:

a stack of corrosion-resistant wire mesh layers inside a hollow tube, which has first and second opposing open ends and an inside diameter, each wire mesh layer of the stack of wire mesh layers being substantially planar and substantially parallel to the other wire mesh layers of the stack of wire mesh layers, the wire mesh layers abutting each other, the stack of wire mesh layers comprising:

a first wire mesh layer comprising a first set of substantially parallelogram-shaped openings each of which has a first open area sufficient to allow gaseous molecules to pass there through;

a second wire mesh layer comprising a second set of substantially parallelogram-shaped openings each of which has a second open area sufficient to allow gaseous molecules to pass there through, the second open area being less than the first open area; and a third wire mesh layer comprising a third set of substantially parallelogram-shaped openings each of which has a third open area sufficient to allow gaseous molecules to pass there through, the third open area being less than the second open area;

wherein the first, second and third open areas are sized, shaped and arranged such that, molecules of gas passing through the wire mesh layers travel along a path through the stack of which mesh layers, which is at least partially boustrophedonic and travel over a surface of at least one wire in each of the substantially parallel wire mesh layers;

wherein the wire mesh layers are formed of non-intumescent wire such that the wire mesh layers will not swell when heated and will not seal the hollow tube when the wire mesh layers are heated.

11. The flame arrestor of claim 10, wherein the number of layers and the open areas of the parallelogram-shaped openings in the plurality of wire mesh layers are selected and arranged such that there is substantially no pathway through the plurality of wire mesh layers through which a plurality of gas molecules can pass without striking at least one wire in each wire mesh layer.

12. The flame arrestor for a safety cabinet of claim 10, further comprising:

and a ring having an outside diameter and an inside diameter, the ring being located inside the hollow tube proximate the second end of the tube;

wherein the wire mesh layers are substantially round and stacked together inside the hollow tube such that they abut each other;

wherein the substantially round wire mesh layers have an outside diameter less than the inside diameter of the hollow tube but greater than the inside diameter of the ring;

wherein the ring closes a space located between the outside diameter of the wire mesh layers and the inside diameter of the hollow tube.

13. A cabinet for storing volatile fluids, the cabinet having an interior space and comprising:

a top panel;

a bottom panel;

a rear panel;

first and second opposing side panels;

at least one door coupled to at least one of the first and second opposing side panels, and a flame arrestor extending through at least one of: the top panel, rear panel and the first and second opposing side panels, the flame arrestor comprising:

a plurality of wire mesh layers fixed in a hollow tube, the hollow tube extending between the interior space and an exterior surface of the cabinet, at least two of the wire mesh layers abutting each other in the hollow tube, the wire mesh layers being substantially planar, substantially parallel to each other and configured such that a plurality of gas molecules passing through the hollow tube pass through the wire mesh layers before said gas molecules enter the safety cabinet interior space wherein the wire mesh layers are formed of non-intumescent wire such that the wire mesh layers will not swell when heated and will not seal the hollow tube when the wire mesh layers are heated.

14. The cabinet for storing volatile fluids of claim 13, wherein first and second wire mesh layers in the hollow tube do not abut each other but are instead separated from each other by a heat-absorbing ring, the heat absorbing ring being sandwiched between the first and second wire mesh layers and sized, shaped and arranged to absorb heat from the first and second wire mesh layers.

15. The cabinet for storing volatile fluids of claim 13, wherein the flame arrestor further comprises:

a metal sealing ring, sized shaped and arranged to close a space located between a periphery of the wire mesh layers and the inside surface of the hollow tube.

* * * * *